US005192140A

United States Patent [19]

Nukada

[11] Patent Number: 5,192,140

[45] Date of Patent: Mar. 9, 1993

[54] APPARATUS AND METHOD OF PRINTING DATA IN A BOOK, A NOTEBOOK, OR THE LIKE

[75] Inventor: Hideki Nukada, Yokohama, Japan

[73] Assignee: Kabushiki Kaisha Toshiba, Kawasaki, Japan

[21] Appl. No.: 617,366

[22] Filed: Nov. 23, 1990

[30] Foreign Application Priority Data

| | | | |
|---|---|---|---|
| Nov. 24, 1989 | [JP] | Japan | 1-303212 |
| Dec. 7, 1989 | [JP] | Japan | 1-316444 |
| Dec. 12, 1989 | [JP] | Japan | 1-320653 |

[51] Int. Cl.[5] ..... B41J 3/28; B41J 13/22

[52] U.S. Cl. ..... 400/26; 400/28; 400/645

[58] Field of Search ..... 101/409; 400/24–28, 400/645, 649; 235/479; 283/57, 64.1; 271/225, 1, 184–186; 281/6–9, 42

[56] References Cited

U.S. PATENT DOCUMENTS

| | | | |
|---|---|---|---|
| 953,875 | 4/1910 | Waring | 400/26 |
| 3,815,722 | 6/1974 | Sessoms | 400/26 |
| 3,868,008 | 2/1975 | Brumbaugh | 400/26 |
| 4,039,069 | 8/1977 | Kwan et al. | 400/25 |
| 4,280,036 | 7/1981 | Fukatsu | 235/379 |
| 4,516,866 | 5/1985 | Yamauchi | 400/25 |
| 4,620,807 | 11/1986 | Polit | 400/56 |
| 4,700,497 | 10/1987 | Sato et al. | 40/531 |
| 4,743,129 | 5/1988 | Keryhuel | 400/582 |
| 4,772,896 | 9/1988 | Nakatsu | 346/76 PH |
| 4,870,258 | 9/1989 | Mochizuki et al. | 400/25 |
| 5,026,180 | 6/1991 | Tajima et al. | 101/409 |

FOREIGN PATENT DOCUMENTS

| | | | |
|---|---|---|---|
| 61279 | 4/1985 | Japan | 400/708 |
| 199668 | 8/1988 | Japan | 400/24 |
| 2104493 | 3/1983 | United Kingdom . | |

OTHER PUBLICATIONS

IBM Technical Disclosure Bulletin, "Passbook Clamping Mechanism For a Rotary Feed Drum," Hama and Tsukemoto, vol. 27, No. 6, Nov. 1984, pp. 3427–3428.

IBM Technical Disclosure Bulletin, "Auto Turn-Page Mechanism For Passbook Printer" vol. 30, No. 5, Oct. 1987, pp. 4–6.

IBM Technical Disclosure Bulletin, "Auto Turn Page Mechanism For Passbook Printer" vol. 30, No. 11, Apr. 1988, pp. 193–195.

IBM Technical Disclosure Bulletin "Drum Transport Document Printing and Handling Mechanism" vol. 19, No. 9, Feb. 1977, pp. 3536–3539.

Patent Abstracts of Japan, vol. 13, No. 265, (M-839) (3613), Jun. 19, 1989 & JP-A-1 064 879 (NEC Corp.), Mar. 10, 1989.

*Primary Examiner*—Clifford D. Crowder
*Assistant Examiner*—Stephen R. Funk
*Attorney, Agent, or Firm*—Oblon, Spivak, McClelland, Maier & Neustadt

[57] ABSTRACT

An apparatus for printing data on any specified page of a book includes a book-transporting mechanism for transporting the book to a predetermined position, while keeping a selected page of the book opened and located substantially parallel to the other pages including a specified page on which to print data. A platen roller is arranged near the other pages of the book transported to the predetermined position. The specified page is turned from the other pages of the book by a page-turning mechanism and the fore-edge portion of the specified page is guided onto the platen roller. The apparatus includes a chucking mechanism for chucking the fore-edge portion of the specified page on the platen roller, and a tension-applying mechanism for pulling the selected page away from the specified page to apply a tension on the specified page through the seam of the book. Data is printed on the specified page applied with the tension, by a printing mechanism.

7 Claims, 8 Drawing Sheets

APPARATUS AND METHOD OF PRINTING DATA IN A BOOK, A NOTEBOOK, OR THE LIKE

BACKGROUND OF THE INVENTION

1. Field of the Invention

The present invention relates to an apparatus and method of printing data on any desired page of a book, a notebook, a bank book, or the like.

2. Description of the Related Art

Generally, books are manufactured in the following steps. First, a plurality of sheets of paper of the same size is prepared. Then, different items of data are printed on each sheet. Next, the printed sheets are bound together, thus forming a book. Usually, once a book has been thus manufactured, a printing process is not performed several times to print different items of data on any specified page of the book. It is well expected that it will be necessary to print various items of data on any specified page of a book, a notebook, or the like, in any specified region of a page. The following problems will arise in performing printing several times to print data items on a specified page of a book.

1) In a multilayer printing, e.g., a multicolor printing, a yellow image, a magenta image, and a cyan image must be sequentially printed on a desired page of a book. Unless the page is set at the same portion every time an image is printed, thereby printing the three images in complete alignment, the resultant color image or characters will not look as beautiful as is desired.

2) To print data on the whole area of a page of a book, the book must be fully opened. When the book is opened too much, the seamed portion of the pages may be damaged.

3) To print data in a specified region (e.g., a line or a box) on the desired page of a bank book, the page must be set at a correct position. Otherwise, the data will be printed outside the specified region, or partly within and partly without the region.

SUMMARY OF THE INVENTION

Accordingly, it is the object of this invention to provide an apparatus and method of printing data in a book, a notebook, or the like, which can securely print data at a specified position on any page of the book, the notebook or the like and which is free of the problems pointed out above.

Generally, it is necessary to reciprocate a print head several times over the same portion of a sheet of paper, in order to print data on that portion of the sheet repeatedly. Often the sheet is moved a little as the head moves in frictional contact with the sheet after different data has been printed on the sheet. Consequently, the newly printed data is not aligned with the previously printed data, causing a print drift and, inevitably, impairing the print quality. To prevent such a print drift, the sheet may be stretched and held tense and flat.

The applicant of the present invention pays attention to the matter that a plurality of pages of a book and the like are fastened together at the seam portion, and proposes a structure and a method for tensing and flattening the page on which to print data (hereinafter called "print page"), without directly stretching the page. Specifically, in the present invention, the print page is not stretched. Rather, any one of the other pages is pulled while the print page is held at its fore-edge portion. The pull applied on the other page acts on the print page, too, through the seam of the book, since all the pages are fastened together at the seam. Not only the page being pulled, but also the print page is rendered tense and flat. Hence, there will occur no print drift, no matter how many times data is printed on the same specified region of the print page. High-quality printed data, e.g., a color image without no color drift, can be obtained.

In order to directly stretch the print page tense and flat, the four corners of the page may be held and pulled outwards. This method cannot be used when data is to be printed on the entire print page, since the corners of the page are covered by the holders. To print data on the entire page, it is desirable to apply a tension on any page other than the print page. It is more desirable to apply a tension on the front or back cover of the book which is thicker than the pages and less liable to be damaged.

According to the present invention, there is provided a printing apparatus for printing data on any specified page of a book formed of a plurality of pages fastened together at a seam, said printing apparatus comprising: means for positioning and holding the specified page; tension-applying means for pulling any selected page of the book, other than the specified page on which to print data, thereby to apply a tension on the specified page through the seam of the book; and means for printing data on the specified page applied with the tension.

According to the invention, there is also provided a printing method comprising the steps of: positioning and holding a specified page of a book on which data will be printed; pulling any other page of the book, thereby to apply a tension on the specified page through a seam of the book; and printing data on the specified page applied with the tension.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 to 13 show a printing apparatus according to an embodiment of the present invention, in which:

FIG. 1 is a left-side view of the apparatus, illustrating the internal structure of the apparatus;

FIG. 2 is a right-side view of the apparatus, showing the internal structure thereof;

FIG. 3 is a plan view schematically showing the printing apparatus while a printing mechanism is removed;

FIG. 4 is a perspective view showing a platen roller and also the components associated with the platen;

FIG. 5 is a perspective view showing a chucking mechanism of the apparatus;

FIG. 6 is a side view illustrating the chucking mechanism in its opened state;

FIG. 7 is a side view showing the chucking mechanism in its closed state;

FIGS. 8 to 13 are side views, explaining how the apparatus operates;

DETAILED DESCRIPTION OF THE PREFERRED EMBODIMENTS

An embodiment of the invention, which is an apparatus for printing data in a bank book, will be described with reference to the accompanying drawings.

Figure 1:
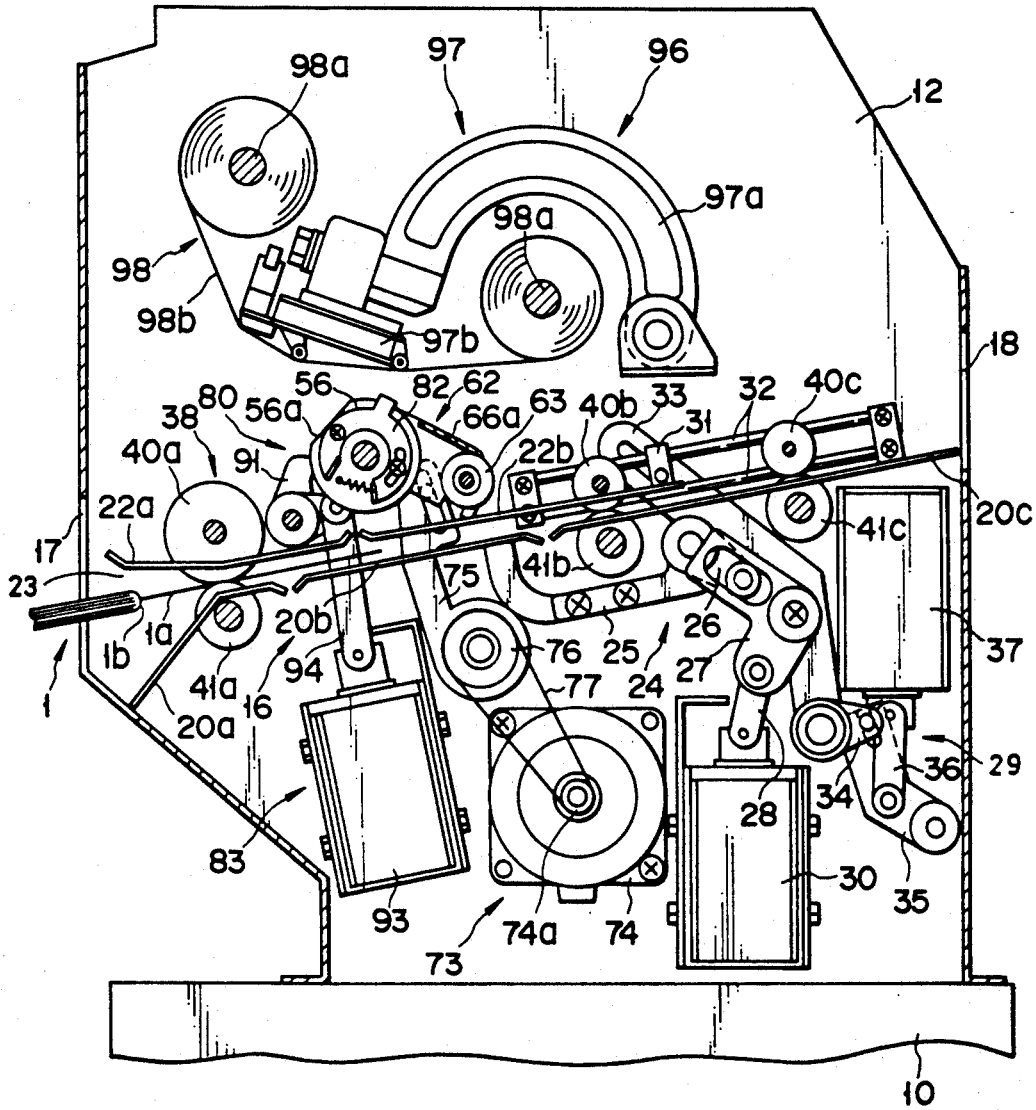
Figure 2:
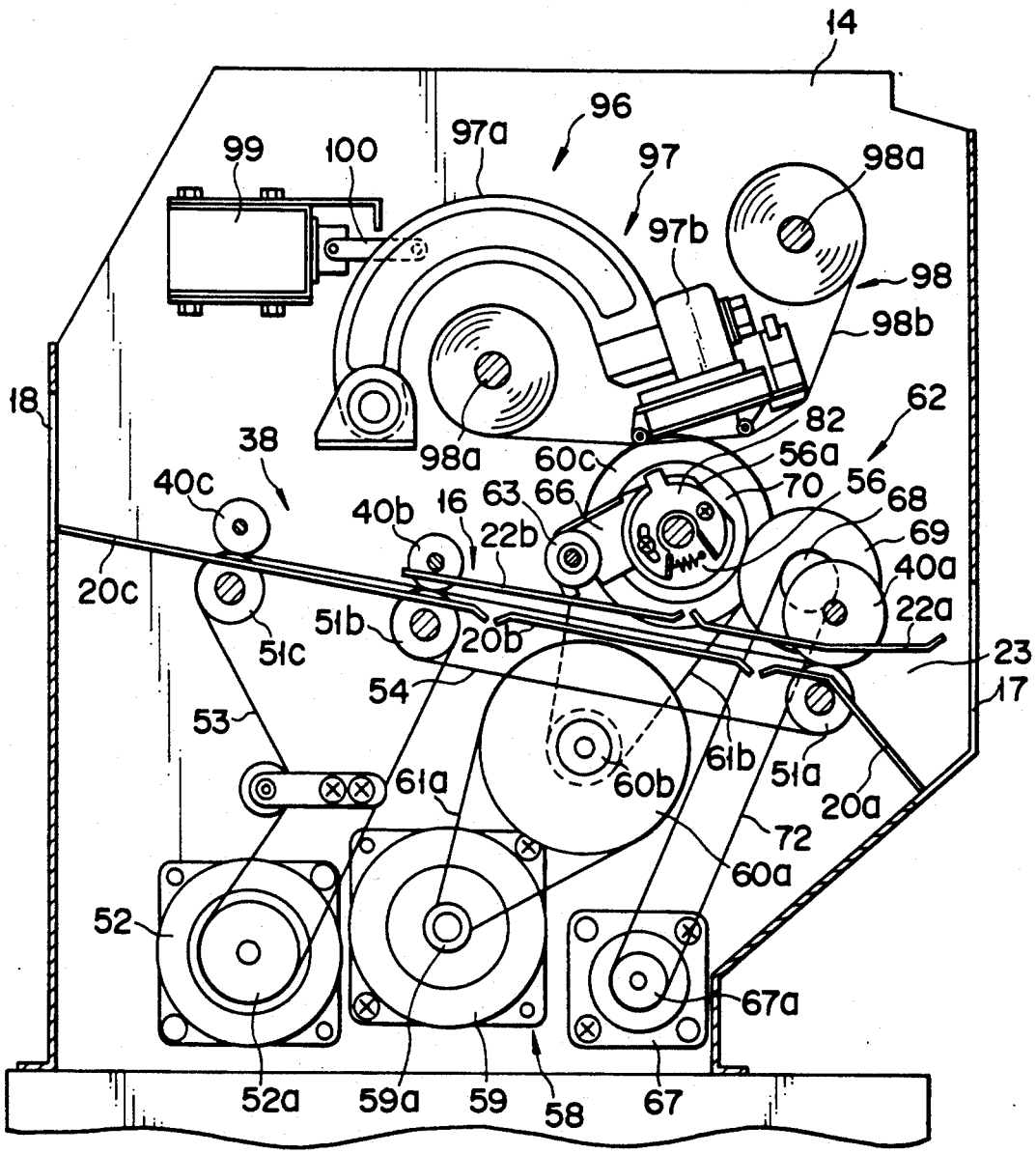
Figure 3:
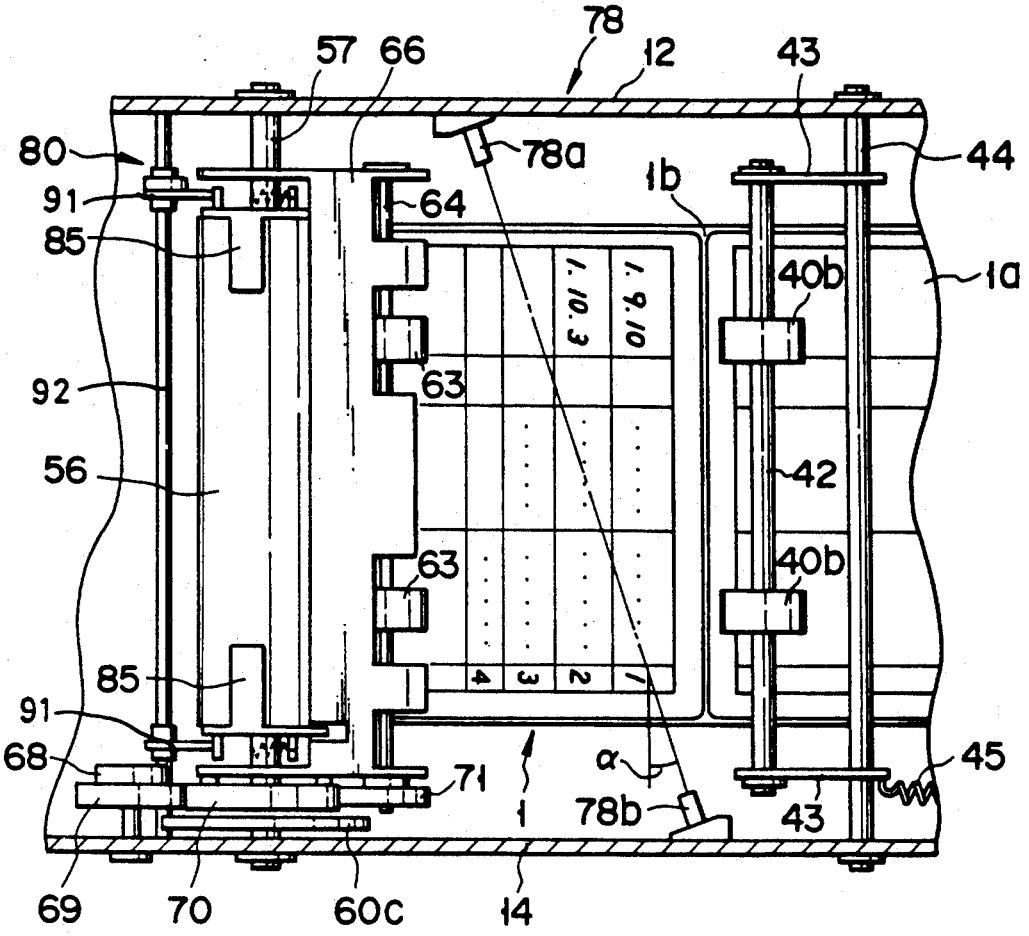
Figure 4:
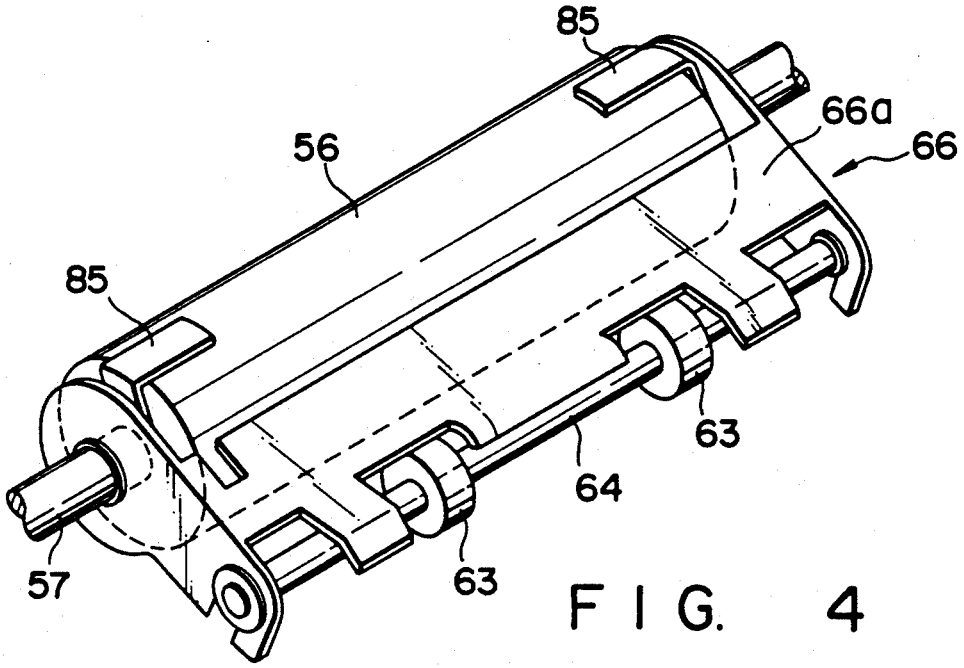

As shown in FIGS. 1 to 3, the printing apparatus comprises a base 10, two parallel side walls 12 and 14, a front wall, and a rear wall. The side walls 12 and 14, the front wall and the rear wall are connected at their vertical sides, thus forming a housing. Arranged in this housing are: a book-guiding mechanism 16, a book-transporting mechanism 38, a page-turning mechanism 62, a page-holding mechanism 80 for holding the page of the book, a printing mechanism 96, and various drive mechanisms (later described) for driving the above-mentioned mechanisms. An inlet port 17 is made in the front wall, and an outlet port 18 is formed in the rear wall.

The guiding mechanism 16 comprises three lower guides 20*a*, 20*b*, and 20*c*, and two upper guides 22*a* and 22*b*. The lower guides 20*a* to 20*c* are arranged in end-to-end relation, between the inlet port 17 and the outlet port 18. Similarly, the upper guides 22*a* and 22*b* are arranged in end-to-end relation, and continuously extend from the inlet port 17 toward the outlet port 18. The upper guides are parallel to the lower guides, and a book-transporting path 23 is defined between the lower guides 20*a* to 20*c*, on the one hand, and the upper guides 22*a* and 22*b*, on the other. The path 23 has a height slightly greater than the thickness of a bank book 1. The inlet portion of the path 23 close to the inlet port 17 is made broader than the other portion of the path. Therefore, the bank book 1 can easily be inserted into the path 23 and smoothly transported through the path 23 from the inlet port 17 to the outlet port 18.

The second lower guide 20*b* is arranged to be rotatable and moved between an upper position (FIG. 1) and a lower position (FIG. 10) by a lower guide drive mechanism 24. In the upper position, the guide 20*b* defines the path 23. The drive mechanism 24 has an arm 25 which is connected at one end to the second lower guide 20*b* and rotatably coupled at the other end to the side wall 12. The other end of the arm 25 is also connected to a plunger/solenoid unit 30 by a cam 26, a lever 27, and a connecting arm 28. When the unit 30 is turned on, the second lower guide 20*b* is rotated from the lower position to the upper position.

The second upper guide 22*b* arranged to be movable along the path 23 between a forward position (FIG. 1) and a rearward position (FIG. 9), and can be moved by an upper guide drive mechanism 29. When set in the forward position, the second upper guide 22*b* has its forward end located adjacent to the first upper guide 22*a*, and its rear end facing to the middle portion of the third lower guide 20*c*. When set in the rearward position, the second upper guide 22*b* has its forward end aligned with that of the third lower guide 20*c*, and its rear end located in the vicinity of the outlet port 18.

The upper guide drive mechanism 29 has a pair of sliders 31 (only one shown) and a pair of guide rods 32 slidably supporting the sliders 31. Both sliders 31 are fastened to the sides of the rear-end portion of the guide 22*b*, respectively. The guide rods 32 are attached to the side wall 12 or 14 and extend parallel to the book-transporting path 23. One of the sliders 31 is partly inserted in an elongated hole made in the distal end of an arm 33 which is rotatably attached to the side wall 12. The proximal end of the arm 33 is connected to a plunger/solenoid unit 37 by a cam 34, a lever 35 attached to the side wall 12, and a connecting arm 36. When the unit 37 is turned on, both sliders 31 are moved toward the inlet port 17, sliding on the guide rods 32, whereby the second upper guide 22*b* is moved to the forward position.

As is shown in FIG. 1, the bank book 1 is inserted into the path 23 through the inlet port 17, with its cover 1*a* opened and the seam 1*b* extending horizontally and perpendicular to the longitudinal axis of the path 23. Once in the path 23, the book 1 is transported toward the outlet port 18 by means of the book-transporting mechanism 38.

As is illustrated in FIGS. 1 and 2, the book-transporting mechanism 38 comprises three upper rollers 40*a*, 40*b* and 40*c*, and three lower rollers 41*a*, 41*b* and 41*c*—all arranged parallel to each other and along the book-transporting path 23. The upper rollers 40*a*, 40*b* and 40*c* are set in rolling contact with the lower rollers 41*a*, 41*b* and 41*c*, respectively, and apply a predetermined pressures thereto. The rollers 40*a* and 40*b* are spaced apart for a distance which is longer than the width of the cover 1*a* and shorter than the width of the book 1 opened. The rollers 40*b* and 40*c* are spaced apart for a distance which is shorter than the width of the cover 1*a*. The rollers of the mechanism 38 are rotatably mounted on axles extending between the side walls 12 and 14. All these rollers, but the second upper roller 40*b*, consists of two rollers each.

Figure 8:
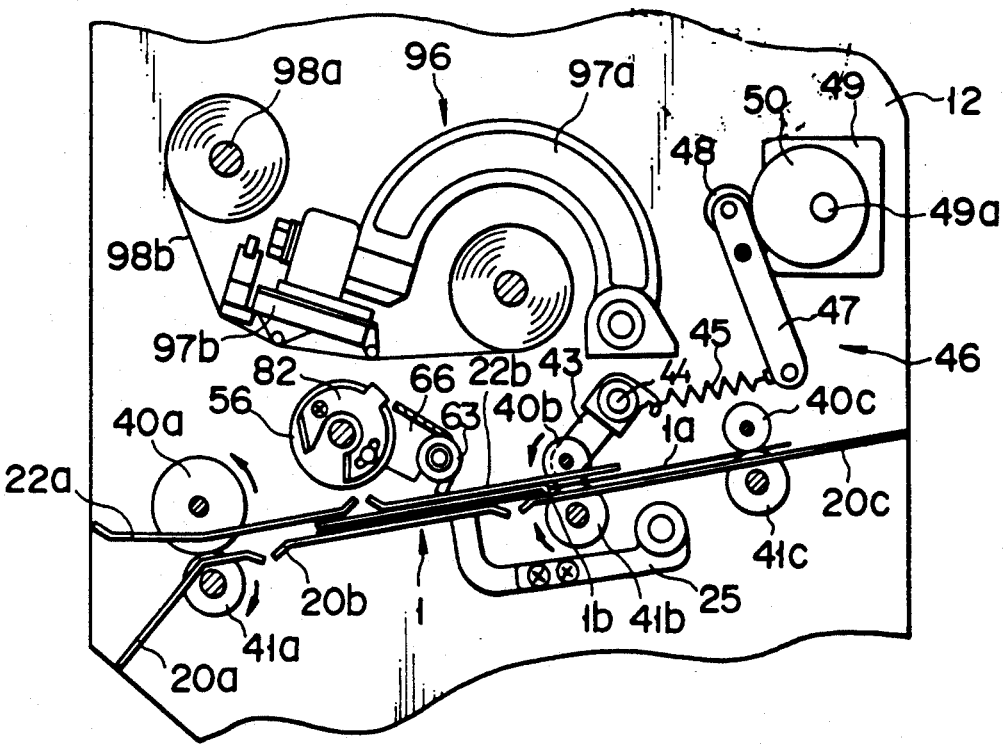

As is evident from FIGS. 3 and 8, the second upper roller 40*b* consists of two rollers which are rotatably mounted on a shaft 42 extending horizontally and perpendicular to the longitudinal axis of the book-transporting path 23. The shaft 42 is rotatably supported, at both ends, by support arms 43 which in turn is rotatably supported, at one end, by an axle 44 extending between the side walls 12 and 14. Hence, as the support arms 43 rotate up and down, the rollers 40*b* are moved onto the second lower rollers 41*b* and away therefrom. One of the support arms 43 is connected by a tension spring 45 to a pressure-adjusting mechanism 46.

As is shown in FIG. 8, the pressure-adjusting mechanism 46 comprises a lever 47, an idler roller 48, an electric motor 49, and an eccentric cam 50. The substantially intermediate portion of the lever 47 is rotatably supported by the side wall 12. The idler roller 48 is rotatably mounted on one end of the lever 47. The tension spring 45 is connected to the other end of the lever 47. The motor 49 is fastened to the side wall 12. The eccentric cam 50 is fixed to the drive shaft 49*a* of the electric motor 49 and contacts the idler roller 48. As long as the cam 50 takes the position shown in FIG. 8, the lever 47 pulls the spring 45, thus biasing the support arms 43 to rotate counterclockwise around the axle 44. In this condition, the rollers 40*b* are pressed onto the second lower rollers 41*b*, applying a predetermined pressure to the rollers 41*b*. When the motor 49 rotates the eccentric cam 50, the lever 47 is rotated clockwise, allowing the spring 45 to contract, which decreases the pressure the roller 40*b* applies to the roller 41*b* decreases.

As is clearly illustrated in FIG. 2, the book-transporting mechanism 38 further comprises an electric motor 52 fixed to the side wall 14. A drive pulley 52a is secured to the drive shaft of the motor 52. Three pulleys 51a, 51b and 51c are fixedly mounted on the shafts of the lower rollers 41a, 41b and 41c, respectively. An endless belt 53 is wrapped around the drive pulley 52a, the second pulley 51b and the third pulley 51c. An endless belt 54 is wound around the first pulley 51a and the second pulley 51b. When the motor 52 is turned on, the pulley 52a is rotated, whereby the lower rollers 41a, 41b and 41c are rotated in the same direction. These rollers 41a, 41b and 41c have the same diameters, and are thus rotated at the same speed. Since the upper rollers 40a, 40b and 40c are in rolling contact with the lower rollers 41a, 41b and 41c, respectively, while applying the predetermined pressure thereto, they are also rotated as long as the drive pulley 52a is rotating. Hence, no drive means are required to rotate the upper rollers 40a to 40c. As the upper rollers 40a to 40c and the lower rollers 41a to 41c are thus rotated, the bank book 1 is transported forward through the path 23, while being pinched between the rollers of each pair.

As is shown in FIGS. 1 to 4, a platen roller 56 is located above the upper guides 22a and 22b. The roller 56 is used to support any page of the book 1 so that data is printed on the page. This roller 56 is fixedly mounted on a platen shaft 57 which extends horizontally and at right angles to the path 23, and is rotatably supported at both ends by the side walls 12 and 14. Part of the outer circumference of the platen roller 56 is cut out to form a flat surface 56a which extends parallel to the axis of the platen 56. The roller 56 is rotated by a platen drive mechanism 58.

The platen drive mechanism 58 comprises an electric motor 59, a first pulley 60a, a second pulley 60b, and a third pulley 60c. The motor 59 is fastened to the side wall 14. The first pulley 60a is rotatably attached to the side wall 14. The second pulley 60b has a smaller diameter than the first pulley 60a and is integrally formed therewith. The third pulley 60c is fixedly mounted on the platen shaft 57. A drive pulley 59a is fixed on the drive shaft of the electric motor 59. An endless belt 61a is wound around the drive pulley 59a and the first pulley 60a. An endless belt 61b is wound around the second pulley 60b and the third pulley 60c.

The page-turning mechanism 62 comprises a pair of page-turning rollers 63. These rollers 63 are located near the platen roller 56 and above the second upper guide 22b. Both rollers 63 are fixed on a shaft 64 which extends horizontally and parallel to the platen shaft 57. The shaft 64 is rotatably supported, at both ends, by a roller holder 66. The holder 66 is rotatably supported by the platen shaft 57 and can, therefore, rotate independently of the platen roller 56 and holds the shaft 64 of the page-turning rollers 63 always at a predetermined distance from the platen shaft 57. The holder 66 has a guide surface 66a which extends along the tangent to the roller 56 from a position near the circumference of the roller 56 to a position near that of the page-turning rollers 63. The circumference of either roller 63 is a layer of material having a great friction coefficient, such as rubber.

The page-turning mechanism 62 further comprises an electric motor 67, a pulley 68, a drive roller 69, a first driven roller 70, an a second driven roller 71. The motor 67 is fastened to the side wall 14. The pulley 68 is integrally formed with the drive roller 69 and has a diameter smaller than that of the roller 69. The drive roller 69 is rotatably connected to the side wall 14. The first driven roller 70 is rotatably mounted on the platen shaft 57. The second driven roller 71 is fixed to the shaft 64. A drive pulley 67a is fastened to the drive shaft of the motor 67. An endless belt 72 is wrapped around the drive pulley 67a and the pulley 68. As is best shown in FIG. 3, the first driven roller 70 is set in rolling contact with the drive roller 69 and the second driven roller 71. Hence, when the motor 67 is turned on, its driving force is transmitted to the page-turning rollers 63 by the belt 72, the pulley 68, and the rollers 69, 70 and 71.

As is shown in FIG. 1, the page-turning mechanism 62 has a holder-driving mechanism 73 for rotating the roller holder 66 to move the page-turning rollers 63 to a desired position, for example, a position where they contact that page of the book 1 on which to print data. The mechanism 73 comprises an electric motor 74 and an arm 75. The motor 74 is fixed to the side wall 12. One end of the arm 75 is rotatably mounted on an axle fastened to the side wall 12. The arm 75 has an elongated hole in its distal portion. A pin protruding from the roller holder 66 is inserted in this elongated hole. A pulley 76 is fixed to the arm 75, coaxial with the axle thereof. A drive pulley 74a is connected to the drive shaft of the motor 74. An endless belt 77 is wrapped around the drive pulley 74a and the pulley 76. Hence, the driving force of the motor 74 is transmitted to the arm 75 by the pulleys 74a and 76 and the endless belt 77, whereby the roller holder 66 is rotated to move the page-turning rollers 63 to the desired position.

As is illustrated in FIG. 3, a sensor 78 is located above the second upper guide 22b and between the second upper rollers 40b and the page-turning rollers 63. The sensor 78 is used to detect how the pages of the bank book 1 are being turned. The sensor 78 has a light-emitting element 78a and a light-receiving element 78b. The element 78a is secured to the side wall 12, for emitting a light beam. The element 78b is secured to the side wall 14 and opposes the light-emitting element 78a, for receiving the light beam emitted therefrom. Both elements 78a and 78b are inclined at a predetermined angle $\alpha$ to the seam 1b of the bank book 1, so that the light beam propagates from the element 78a to 78b in a line inclined at the same angle to the seam 1b of the book 1.

When the page-turning mechanism 62 turns any page of the bank book 1, the page is bent or waved. The crest of the waved page interrupts the light beam emitted from the light-emitting element 78a. As a result of this, the sensor 78 detects that the page is turned correctly.

The printing apparatus further comprises a chucking mechanism 80 (or a page-holding mechanism) which cooperates with the platen roller 56 to position and holds the print page.

As is shown in FIG. 1, FIGS. 3 to 5, and FIG. 7, the chucking mechanism 80 comprises a pair of chucking members 82 and a drive unit 83. The chucking members 82 are attached to the ends of the platen roller 56, respectively. The drive unit 83 is provided for driving these members 82. Either chucking member 82 has a semi-circular support plate 84 and a chucking arm 85. The support plate 84 is mounted on the end face of the platen roller 56 and is coaxial therewith. The chucking arm 85 protrudes from the circumference of the support plate 84 and extends along the circumference of the roller 56 and parallel to the axis of the roller 56. The semicircular support plate 84 has a circular hole 84a and an elongated hole 84b, which are located diametrically opposite to each other. The elongated hole 84b extends in a circle concentric to the circular hole 84a. The support plate 84 is connected to the end face of the platen roller 56 by two screws 86*a* and 86*b*. The screw 86*a* extends through a washer and the hole 84*a* and is set in screw engagement with the roller 56. Similarly, the screw 86*b* extends through a washer and the hole 84*b* and is set in screw engagement with the roller 56. Both screws 86*a* and 86*b* are loosely screwed into the platen roller 56, and the support plate 84 can rotate about the screw 86*a* until either end of the elongated hole 84*b* abuts on the screw 86*b*. A rubber pad 85*a*, which has a great friction coefficient, is secured to that side of the chucking arm 85 which opposes the platen roller 56.

A connector 87 is formed on that end of the support plate 84 which is close to the elongated hole 84*b*, and a connector 88 protrudes from the end of the platen roller 56. A tension spring 89 is stretched between these connectors 87 and 88, biasing the support plate 84 clockwise around the screw 86*a*. Hence, the chucking arm 85 is pressed onto the circumference of the platen roller 56. An engagement portion 90, which can engage with the drive unit 83, is formed on that end of the support plate 84 which is close to the circular hole 84*a*.

The drive unit 83 has a pair of claws 91 which can abut against the engagement portions 90 of the chucking members 82. These claws 91 are fastened to a shaft 92. The shaft 92 is rotatably supported at both ends by the side walls 12 and 14 and extends parallel to the platen roller 56. One of the first claws 91 is connected by a connecting rod 94 to a plunger/solenoid unit 93 which is secured to the side wall 12. Usually, the claws 91 are spaced at some distance from the engagement portions 90 of the chucking members 82. Thus, the chucking member 82 is held at the chucking position shown in FIG. 7 due to the force of the spring 89. When the plunger/solenoid unit 93 is turned on in order to print data on any page of the bank book 1, the connecting rod 94 is moved such that the claws 91 are rotated in the direction of arrow A (FIG. 5), along with the shaft 92. Each claw 91 abuts on the engagement portion 90 of the corresponding chucking member 82. Each chucking member 82 is therefore rotated to the waiting position (FIG. 6) against the force of the spring 89. While set in the waiting position, the pad 85*a* of the chucking arm 85 remains away from the circumference of the platen roller 56. When the print page of the bank book 1 is inserted into the gap between the platen roller 56 and the arm 85, the plunger/solenoid unit 93 is turned off. Either chucking member 82 is rotated from the waiting position to the chucking position, whereby the rubber pad 85*a* is pressed onto the circumference of the platen roller 56. As a result of this, the print page is clamped between the platen roller 56 and both chucking arms 85 and, thus, held at a predetermined position.

Figure 5:
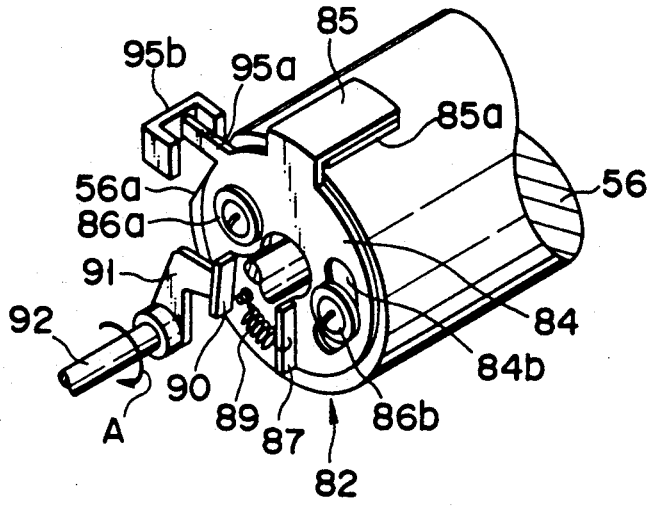
Figure 6:
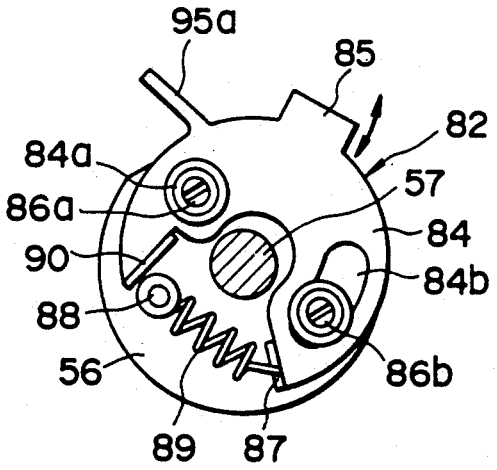
Figure 7:
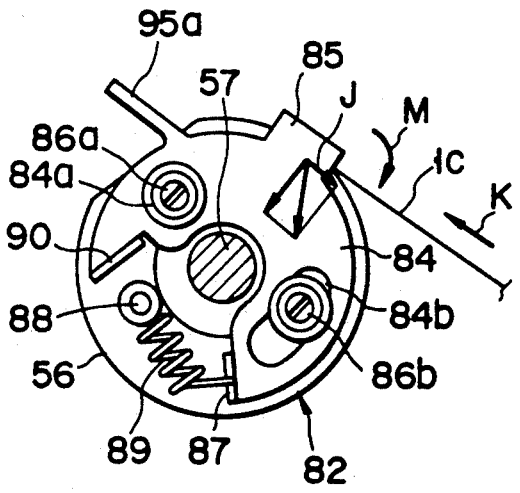

As is illustrated in FIGS. 5 to 7, a detection rod 95*a* extends from one of the chucking members 82 in the radial direction thereof. The distal end of this rod 95*a* is placed in the recess of a chuck sensor 95*b* which is fastened to the side wall 14. The sensor 95*b* has a light-emitting element and a light-receiving element which oppose each other across the recess. When the rod 95*a* slightly rotates in interlock with the rotation of the chucking member 82, the sensor 95*b* detects a minute movement of the rod 95*a* and outputs an electric signal. This signal is supplied to a control device (not shown).

The initial value for the output signal of the chuck sensor 95*b* is obtained in the following manner. First, both chucking members 82 are located at the chucking position, and nothing is inserted in the gap between the platen roller 56 and both chucking arms 85. In this condition, the sensor 95*b* detects the position of the rod 95*a* and generates an electric signal. The level of this signal is used as the initial value of the output signal of the chuck sensor 95*b*.

The initial value for the output signal of the chuck sensor 95*b*, thus obtained, is stored into a memory incorporated in the control device. When the print page of the book 1 is held between the platen roller 56 and the chucking arms 85, the arms 85 is slightly spaced apart from the circumference of the roller 56 by the distance equal to the thickness of the print page. By detecting this distance, it is possible to determine that the print page is correctly held between the platen roller 56 and the chucking arms 85 or not. More precisely, when the page is inserted into between the roller 56 and the arms 85, the chucking member 82 rotates by a very small angle. Simultaneously, the detection rod 95*a* moves within the recess of the chuck sensor 95*b* for a short distance proportional to the angle of rotation of the chucking member 82. This motion of the rod 95*a* is detected by the chuck sensor 95*b*, which outputs a signal to the control device. Since the rod 95*a* protrudes rather long from the chucking member 82, the minute rotation of the member 82 is translated into the prominent motion of the rod 95*a* which the chuck sensor 95*b* can detect with high reliability.

As is evident from FIGS. 1 and 2, the printing mechanism 96 is arranged above the platen roller 56. The printing mechanism 96 comprises a head unit 97 and a ribbon unit 98. The head unit 97 has a support arm 97*a* and a print head 97*b*. The arm 97*a* is rotatably connected at proximal end to the side wall 12. The print head 97*b* is fastened to the distal end of the arm 97*a* and located above the platen roller 56. The ribbon unit 98 has a pair of reels 98*a* and a length of ink ribbon 98*b*. The reels 98*a* are rotatably supported between the side walls 12 and 14. The ink ribbon 98*b* is fed from the first reel 98*a*, guided through the gap between the roller 56 and the print head 97*b*, and taken up around the second reel 98*a*. The print head 97*b* is a thermal head, and applies heat to the ink ribbon 98*b*, thereby to transfer the ink from the ribbon 98*b* onto the print page of the book 1. The ink ribbon 98*b* has a yellow region, a magenta region, and a cyan region, so that the printing apparatus can print not only characters but also color images in the book 1.

The support arm 97*a* is connected to a plunger/-solenoid unit 99 by means of a connecting rod 100. The plunger/solenoid unit 99 is secured to the side wall 14. Usually, the print head 97*b* is spaced apart from the platen roller 56. When the unit 99 is turned on, the arm 97*a* is rotated toward the platen roller 56 until the print head 97*b* is brought into contact with the platen roller 56.

The operation of the printing apparatus, described above, will now be explained.

First, the book 1, with its cover 1*a* opened, is inserted into the book-transporting path 23 through the inlet port 17 as is illustrated in FIG. 1. At this time, the second lower guide 20*b* has been moved to its upper position by the lower guide drive mechanism 24, and the second upper guide 22*b* has been moved to its The fore-edge portion of the cover 1*a* is held between the first upper rollers 40*a* and the first lower rollers 41*a*. The motor 52 of the book-transporting mechanism 38 is turned, thus rotating the lower rollers 41*a*, 41*b* and 41*c*. The first lower rollers 41*a* and the first upper rollers 40*a* transport the book 1 toward the outlet port 18 The fore-edge portion of the cover 1*a* is pinched between the second upper rollers 40*b* and the second lower rollers 41*b* before the fore edges of the other pages pass the rollers 40*a* and 41*a*. Therefore, the book 1 is continuously transported toward the outlet port 18.

As is shown in FIG. 8, the lever 47 of the pressure-adjusting mechanism 46 is at such a position that the second upper rollers 40*b* contact the book 1, applying the same pressure as any other book-feeding roller. At the time the seam 1*b* of the book 1 reaches a position near the second rollers 40*b* and 41*b*, the motor 52 is turned off, whereby the book 1 is stopped.

Figure 9:
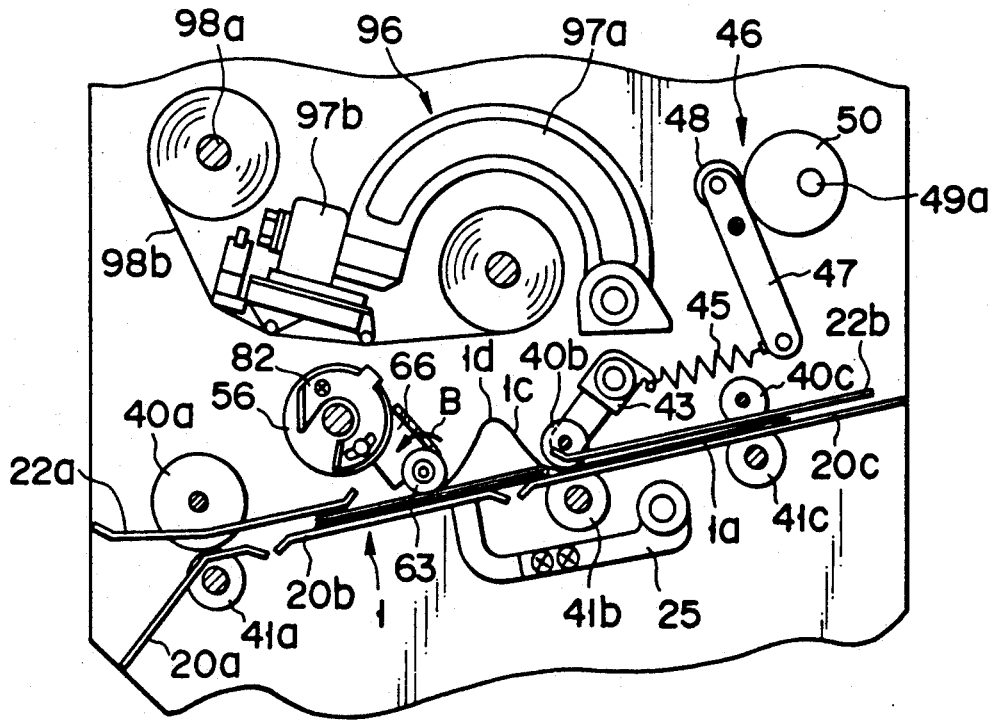

Then, the page-turning mechanism 62 is actuated to turn the pages of the book 1. As is shown in FIG. 9, the upper guide drive mechanism 29 moves the second upper guide 22*b* to its rear position, thus exposing the left pages of the book 1 to the page-turning mechanism 62. The motor 74 of the mechanism 62 is turned on, rotating the roller holder 66 until the page-turning rollers 63 contacts the upper-most left page of the book 1, i.e., the print page 1*c*. The rollers 63 cooperate with the second lower guide 20*b*, applying a sufficient pressure on the left pages of the book 1. In this condition, the motor 67 of the page-turning mechanism 62 is turned on, thereby rotating the rollers 63 in the direction of arrow B (FIG. 9). Thus rotated, the rollers 63 turn the print page 1*c*. Meanwhile, the pressure-adjusting mechanism 46 keeps the second upper rollers 40*b* in contact with the cover 1*a* of the book 1 at sufficient pressure. Hence, the rear-edge portion of the cover 1*a* is held between the rollers 40*b* and 41*b*, and the fore-edge portion of the cover 1*a* is held between the rollers 40*c* and 41*c*. The print page 1*c* can therefore be turned reliably.

Figure 10:
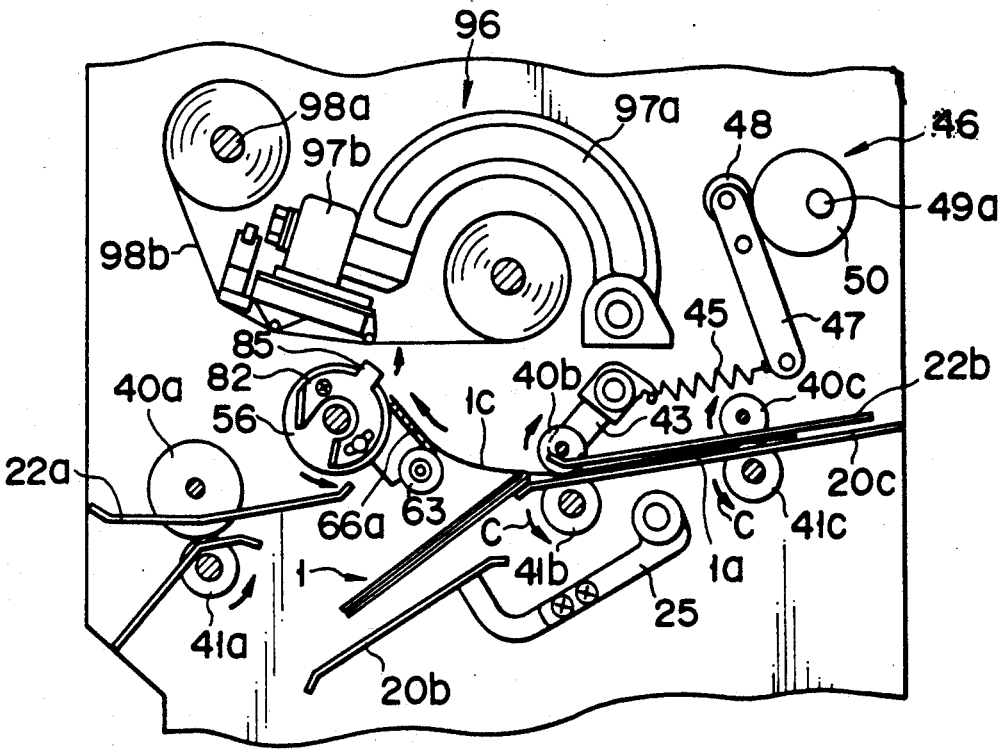

At the time the rollers 63 start turning the print page 1*c*, the lower guide drive mechanism 24 rotates the second lower guide 20*b* to its lower position as is illustrated in FIG. 10. The left pages other than the first left page are thus prevented from being turned. As the rollers 63 is further rotated, the print page 1*c* is bent as is shown in FIG. 9. When the crest 1*d* of the bent portion of the print page 1*c* reaches a predetermined level, the page 1*c* straightens itself due to its elasticity, and place itself upon the guide surface 66*a* of the roller holder 66 as is illustrated in FIG. 10. The moment the crest 1*d* reaches the predetermined level, it interrupts the light beam emitted from the light-emitting element 78*a* of the sensor 78. As a result of this, the sensor 78 detects that the print page 1*c* has been turned correctly, and outputs a signal. This signal is supplied to the control device. Upon receipt of the signal, the control device turns off the motor 67 of the page-turning mechanism 62, thereby stopping the page-turning rollers 63.

Then, as is shown in FIG. 10, the book-transporting mechanism 38 rotates the lower rollers 41*a*, 41*b* and 41*c* in the reverse direction, that is, in the direction of arrow C a predetermined number of times. The lower rollers 41*b* and 41*c* and the upper rollers 40*b* and 40*c* transport the book 1 rearward, that is, toward the inlet port 17. At the same time, the drive unit 83 of the chucking mechanism 80 is actuated, rotating both chucking members 82 to their waiting positions. The chucking arms 85 are thereby moved away from the circumference of the platen roller 56. In the meantime, the fore-edge portion of the print page 1*c* is guided upwards by the guide surface of the roller holder 66 and reaching the circumference of the platen roller 56. Both sides of the fore-edge portion of the page 1*c* are inserted into the gaps between the platen roller 56 and the chucking arms 85.

Figure 11:
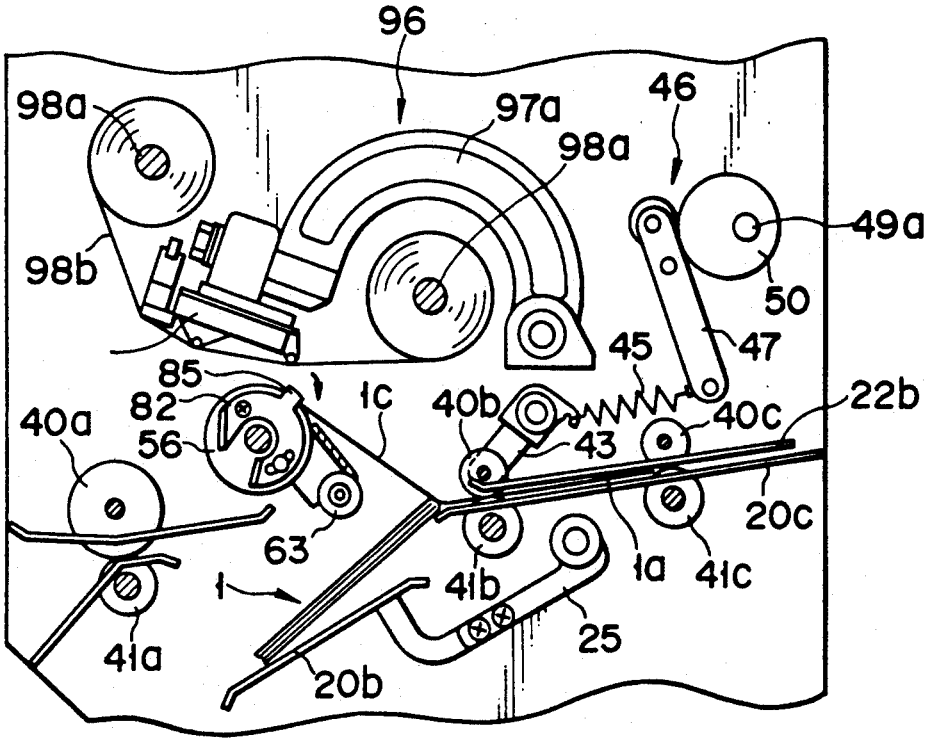

When the supply of power to the drive unit 83 of the chucking mechanism 80 is stopped in this condition, either chucking member 82 is rotated to its chucking position as is shown in FIG. 11 by the spring 89 until the chucking arm 85 presses the fore-edge portion of the print page 1*c* onto the circumference of the platen roller 56. Hence, the print page 1*c* of the book 1 is held at the predetermined position. Since the second lower guide 20*b* is at its lower position at this time, the left page of the book 1 hangs downwards. Meanwhile, the moment the chucking mechanism 80 starts performing its function, the control device compares the initial output value of the chuck sensor 95*b* with the value of the output signal actually output therefrom. If the values compared are equal, the control device determines that the print page 1*c* is not chucked due to its warping or its jamming condition. In this case, the control device prevents the printing mechanism 96 from initiating its function, and turns on the drive unit 83 again or outputs a signal indicative of a trouble in the printing apparatus. On the other hand, if the values compared are different, the control device determines that the print page 1*c* is chucked correctly, and then causes the following printing operation to print data on the print page 1*c*. In the case where the value of the signal output from the chuck sensor 95*b* is much greater or much less than the initial value, the control device determines that two or more pages have been clamped between the platen roller 56 and either chucking arm 85, and performs a different control.

Figure 12:
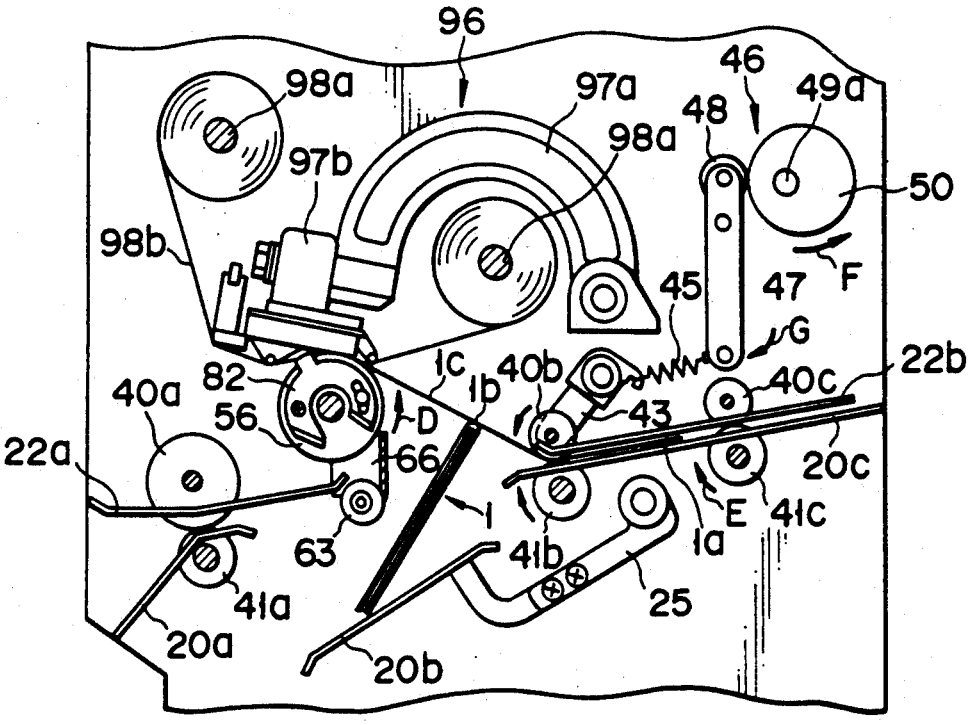

Next, as is shown in FIG. 12, the driving mechanism 73 rotates the page-turning rollers 63, together with the roller holder 66, to the positions near the first upper guide 22*a*. The platen drive mechanism 58 rotates the platen roller 56 in the direction of arrow D for a predetermined angle, while the print page 1*c* is kept held on the platen roller 56. Simultaneously, the motor 52 of the book-transporting mechanism 38 is turned on. As a result of this, the lower rollers 41*a*, 41*b*, and 41*c* are rotated in the direction of arrow E, thereby applying a tension on the cover 1*a* of the book 1. The tension is transmitted via the seam 1*b* to the print page 1*c*. Hence, the print page 1*c* is stretched tense and flat At the same time the rollers 41*a* to 41*c* start rotating, the motor 49 of the pressure-adjusting mechanism 46 is turned on, whereby the eccentric cam 50 is rotated not more than 180 degrees in the direction of arrow F. Then, the idler roller 48 is rotated, thus rotating the lever 47 in the direction of arrow G. The tension spring 45 is therefore compressed, whereby the bias applied on the second upper rollers 40*b* decreases, and the pressure the rollers 40*b* exert on the second lower rollers 41*b* decreases proportionally. The rollers 40*b* therefore slips on the cover 1*a* of the book 1, not transporting the book 1 forward but applying an appropriate tension on the print page 1*c*. As a result, no excessive tension is applied to the print page 1*c*, thus preventing damages thereto.

As may be understood from the preceding paragraph, the second upper rollers 40*b*, the second lower rollers 41*b*, the pressure-adjusting mechanism 46, and the book-transporting mechanism 38 constitute a tension-applying mechanism for applying an appropriate tension to the print page 1*c*. Both the pressure the rollers 40*b* apply on the rollers 41*b* and the tension applied on the print page 1*c* can be controlled by adjusting the angle through which to rotate the eccentric cam 50.

Then, the plunger/solenoid unit 99 of the printing mechanism 96 is actuated, rotating the print head 97*b* until the head 97*b* presses the ink ribbon 98*b* onto the print page 1*c* which is held tense and flat and contact the circumference of the platen roller 56. In this condition, data is printed on the print page 1*c* while tension is applied to the print page 1*c* in the above-mentioned manner.

Figure 13:
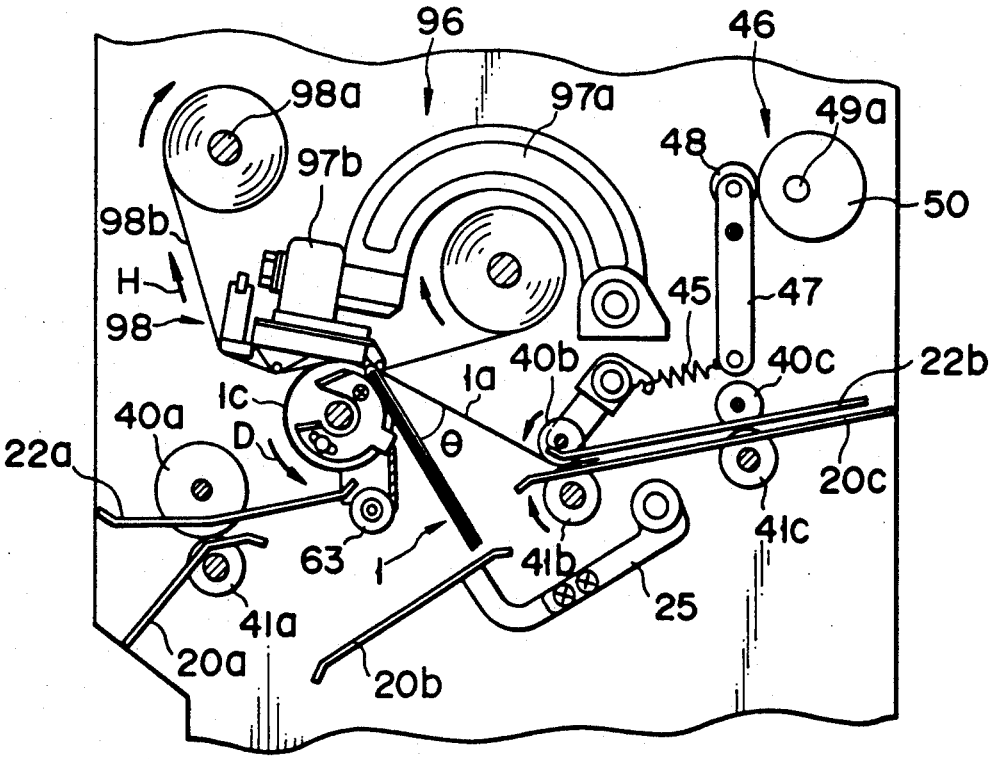

Specifically, as is evident from FIG. 13, the drive mechanism 58 rotates the platen roller 56 in the direction of arrow D by a predetermined angle, whereby the print page 1*c* is fed in the same direction. At the same time, the second reel 98*a* of the ribbon unit 98 is rotated, feeding the ink ribbon 98*b* in the direction of arrow H for a predetermined distance. In the meantime, the print head 97*b* transfers the ink from the ribbon 98*b* onto the print page 1*c*, thus printing data (e.g., characters or images, or both) on the page 1*c*. To accomplish multicolor printing, the steps shown in FIGS. 12 and 13 are repeated three times, for printing a yellow image, a magenta image, and a cyan image in the same region of the print page 1*c*.

In the case where data is printed on almost the entire print page 1*c*, the page 1*c* is wrapped around the platen roller 56 at the end of the printing, and the book 1 takes the specific position illustrated in FIG. 13. Namely, the seam 1*b* of the book 1 is set in contact with the flat surface 56*a* of the platen roller 56, and the cover 1*a* opposes the left pages, defining an acute angle &H together with the left pages.

Upon completion of the printing, the control device controls the various drive mechanisms and drive units, thereby setting the movable components into the condition illustrated in FIG. 8. Then, the book-transporting mechanism 38 is driven, whereby the book 1 is transported through the path 2 and finally ejected through the outlet port 18 from the printing apparatus.

In order to print data on the next page of the book 1, the second lower guide 20*b* is rotated upwards from the position shown in FIG. 10, and the page-turning rollers 63 are moved upwards, away from the the left pages of the book 1. Next, the book-transporting mechanism 38 is actuated, transporting the book 1 toward the inlet port 17. The rollers 63 prevent the print page 1*c*, which is now located above the guide surface 66*a* of either roller 63, from being moving further. The print page 1*c* is therefore turned back to the right and gradually opened as the book 1 is moved toward the inlet port 17. After the print page 1*c* is opened completely, the book-transporting mechanism 38 starts transporting the book 1 toward the outlet port 18, thereby setting the condition shown in FIG. 8. Hence, the page-turning mechanism 62 can turn the page next to the print page 1*c*, and the printing mechanism 96 can print data on the next page.

As has been described, during the printing operation, tension is applied on the cover 1*a* of the book 1 in the transporting direction of the book, so that the cover 1*a* and the print page 1*c* are stretched to locate on a common plane, as shown in FIGS. 11 and 12. After data has been printed on the page 1*c*, and the print page 1*c* is turned, thus opening the next page so that data may be printed on the next page, a tension can be applied on the cover 1*a* or the print page 1*c*, or both. In whichever way the tension is applied, it is applied on the next page, too. The next page, or the new print page, is thereby made tense and flat, minimizing the print drift and achieving high-quality printing, no matter whether the data is characters or images. Since any print page is rendered tense and flat and is also correctly positioned, data can be printed at any specified portion of the page (e.g., a frame or lines, already printed on the page).

In the embodiment described above, the rollers 40*b* and 41*b* applies a tension in the direction at right angles to the seam 1*b* of the book 1. Nevertheless, the tension can be applied to the print page 1*c* in whichever direction by any means other than the rollers 40*b* and be replaced by any known mechanism which performs the same function.

As has been described, the pressure-adjusting mechanism 46 adjusts the pressure the roller 40*b* applies to the roller 41*b*, while rotating the rollers 40*b* and 41*b* at the same speed, in order to control the tension applied on the print page 1*c*. Without the mechanism 46, said pressure would remain unchanged, and it would be necessary to vary the speed of the roller 40*b* in order to control the tension applied on the page 1*c*. Were the speed of the roller 40*b* varied, the roller 40*b* should necessarily be rotated in reverse direction when the page 1*c* is wrapped around the platen roller 56 to some extent. Obviously, it is difficult to rotate the roller 40*b* in the reverse direction at an appropriate time. If the reverse rotation of the roller 40*b* is not timely started, which may happen quite likely, the print page 1*c* will be warped, or an excessive tension will be applied on the seam 1*b*.

When the mechanism 46 reduces the pressure which the roller 40*b* applies to the roller 41*b*, the cover 1*a* can move backward through the gap between the rollers 40*b* and 41*b* even if the tension on the print page 1*c* changes as the print page 1*c* is gradually wrapped around the platen roller 56. Hence, the tension on the page 1*c* is automatically adjusted, and the page 1*c* remains tense and flat. Conversely, when the mechanism 46 increases the pressure the roller 40*b* applies to the roller 41*b*, these rollers 40*b* and 41*b* exerts a force great enough to transport the book 1 toward the outlet port 18. That is, by adjusting the contact pressure between the rollers 40*b* and 41*b* in accordance with the required function, these rollers 40*b* and 41*b* perform various functions with respect to the book. Hence, there is no need to use a drive means exclusively for transporting the book 1 toward the outlet port 18, which helps to simplify the internal structure of the printing apparatus and also to reduce the size of the apparatus.

In view of the two preceding paragraphs, the pressure-adjusting mechanism 46 is one of the characterizing features of the printing apparatus.

As has been pointed out, the second lower roller 41*b* can be stopped and rotated in the reverse direction by the motor 52 of the book-transporting mechanism 38. When the roller 41*b* is rotated in reverse direction, the book 1 is transported to the platen roller 56, whereby data can be printed on the print page 1*c* of the book 1. When the roller 41*b* is stopped, it holds the book 1 in place. As the second lower roller 41*b* moves the book 1 backward at a proper timing and stops the same at an appropriate timing, the page-turning operation can be smoothly performed.

As is illustrated in FIGS. 10 to 13, the second lower guide 20*b* of the book-guiding mechanism 16 can be set at its lower position while data is being printed on the print page 1*c*. When the guide 20*b* is rotated downward, the left pages of the book 1, including the back cover, hang downwards by their own weights. Hence, the left pages are never be clamped between the guide 20*b* and the page-turning rollers 63. If the left pages were clamped between the guide 20*b* and the rollers 63, they would be wrapped around the rollers 63 and curved. The back cover, in particular, which is thicker than the other pages in most cases, would be curved permanently, inevitably shortening the lifetime of the book 1. In order to make the left pages hang downwards, the second lower guide 20*b* can be moved toward the outlet port 18 in the same way as the second upper guide 22*b*.

Since the platen roller 56 has a flat surface 56*a*, the cover 1*a* does not perfectly face to the pages other than the print page 1*c*, as is shown in FIG. 13, even when the print page 1*c* is completely wrapped around the platen roller 56. Rather, the cover 1*a* is inclined at an angle $\theta$ to the other pages. If the roller 56 had not the flat surface 56*a*, the book 1 should be bent double at the seam 1*b*, with the cover 1*a* laid upon the other pages not printed yet, inevitably weakening the seam 1*b* and shortening the lifetime of the book 1.

In other words, due to the flat surface 56*a* of the platen roller 56, the book 1 can last long. The angle $\theta$ can be changed to a desired one by replacing the roller 56 with one having a cross section of a different shape.

As is shown in FIGS. 12 and 13, the page-turning rollers 63 are moved to a position near the first upper guide 22*a*. This also serves to prevent weakening the seam 1*b* and shortening the lifetime of the book 1.

Since the roller holder 66 connects the page-turning rollers 63 to the platen roller 56, the distance between the roller 56 and the rollers 63 remains unchanged. Hence, the print page 1*c* is correctly positioned with respect to the platen roller 56 when the second lower roller 41*b* is rotated by the predetermined angle, no matter which of the page-turning rollers 63 has turned the print page 1*c*.

Moreover, since the guide surface 66*a* of the holder 66 is located between the platen roller 56 and the page-turning rollers 63, it smoothly guides the print page 1*c* to the platen roller 56. It is most desirable that the guide surface 66*a* extend along the tangent to both the platen roller 56 and either page-turning roller 63. However, the guide surface 66*a* can be curved. The guide surface 66*a* also serves to guide the print page 1*c* smoothly to the chucking arms 85.

Further, the guide surface 66*a* contacts the whole print page 1*c* as is illustrated in FIG. 10. Hence, the surface 66*a* supports the page 1*c* until the page 1*c* is wrapped around the platen roller 56. The force applied to the page 1*c* does not concentrate on the fore-edge portion of the page 1*c* to move this portion upwards from the circumference of the platen roller 56.

In the chucking mechanism 80, either chucking member 82 is located such that the platen shaft 57 is positioned between the connector 88 and the chucking arm 85 as is illustrated in FIG. 7. Therefore, the force which moves the arm 85 toward the circumference of the platen roller 56 to press the page 1*c* on the roller 56 has a vector component J which extends opposite to the direction K in which the print page 1*c* is transported.

As has been described, a tension is applied on the page 1*c*, which acts in the direction opposite to the direction K, in order to make the page 1*c* tense and flat before data is printed on the page 1*c*. Therefore, either chucking arm 85 must exert a great force to the print page 1*c* to hold the page 1*c* on the circumference of the platen roller 56. The arm 85 can readily acquire such a great force in the following manner. When the tension is applied on the print page 1*c* in the direction opposite to the direction K, a great friction is generated between the page 1*c* and the rubber pad 85*a*. This friction results in a rotation moment M in the chucking arm 85, which rotates the arm 85 around the screw 86*a*. Since the moment M has a vector component acting in the same direction the tension acts on the page 1*c*, that is, in the direction opposite to the direction K. As a result, the vector component acts on either chucking arm 85 such that the arm 85 presses the print page 1*c* onto the circumference of the platen roller 56, whereby the page 1*c* is firmly held on the circumference of the roller 56.

The greater the tension applied on the print page 1*c*, the greater the rotation moment M of either chucking arm 85. The greater the moment M, the more firmly the chucking arm 85 holds the print page 1*c* on the circumference of the platen roller 56. Even if the pull acting on the page 1*c* increases when, for example, the print head 97*b* slides on the page 1*c*, the page 1*c* does not slip out from between the chucking arm 85 and the circumference of the roller 56, thus ensuring high-quality printing. Since the page 1*c* remains held on the circumference of the platen roller 56 throughout the printing process, the data is never be printed on the circumference of the platen roller 56.

As has been described, the chucking mechanism 80 has the detecting rod 95*a* and the chuck sensor 95*b*, and can reliably detect that the print page 1*c* is chucked firmly on the circumference of the platen roller 56. Thus, when the page 1*c* is not clamped between the platen roller 56 and either chucking arm 85 due to a trouble such as jamming or warping of the page 1*c*, the chuck sensor 95*b* can detect this trouble from the motion of the rod 95*a*, no matter however slight this motion is. In this case, the following printing operation is not performed, and the ink ribbon 98*b* is never directly wound around the platen roller 56.

Figure 14:
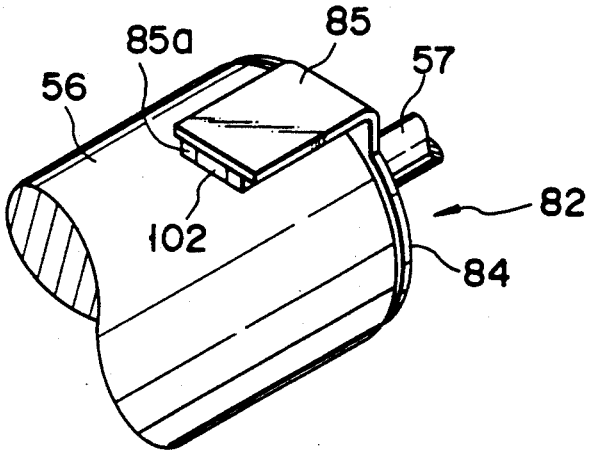
FIG. 14 is a perspective view showing a modified chuck sensor.

The chuck sensor 95*b* can be a pressure sensor 102 which can contact with the circumference of the platen roller 56, as is illustrated in FIG. 14.

As has been described, the printing apparatus has the sensor 78 which detects how the pages of the book 1 are being turned. This is an optical sensor or a so-called "non-contact sensor," and need not contact the pages. As is known in the art, a non-contact sensor operates more accurately than a contact sensor such as a micro switch. The sensor 78 can, therefore, detect how the pages are turned, even if the pages of the book 1 are extremely soft and flexible.

If the sensor 78 were a micro switch, it could not be actuated by the crest 1*d* of the bent portion of the print page 1*c*, which rises gradually as the page-turning rollers 63 are rotated. Thus, the sensor 78 could not detect that the page 1*c* is bent, inevitably failing to determine how the page 1*c* is turned.

Further, since the light-emitting element 78*a* and light-receiving element 78*b* of the sensor 78 are inclined at the predetermined angle $\alpha$ to the seam 1*b* of the book 1, they can be easily arranged outside the book-transporting path 23 as is shown in FIG. 3. Thus, they do not hinder the transportation of the book 1 or the movement of the book 1 during the printing process. Moreover, since the elements 78*a* and 78*b* are inclined at the predetermined angle $\alpha$ to the seam 1*b* of the book 1, the passage of the light beam emitted from the element 78*a* to the element 78*b* is $1/\sin\alpha$ times longer than in the case the elements 78*a* and 78*b* are aligned at right angles to the book-transporting path 23. This is desirable when one or more pages of the book 1 are transparent or semi-transparent, or have a transparent or semi-transparent portion. The longer the path a light beam passes through a transparent or semi-transparent body, the more its intensity is attenuated. The more the intensity of the beam is attenuated, the reliably the transparent or semi-transparent body can be detected. The angle $\alpha$ can be increased in proportion to the transparency of the pages of the book 1, thereby to enhance the accuracy of detecting the turning of pages.

The angle $\alpha$ can be one defined with respect to anything other than the direction in which the book 1 is transported. For example, the angle $\alpha$ can be 0° in the case where the axis of the page-turning rollers 32 is inclined to the direction in which the book 1 is transported. In this case, the crest 1*d* of the bent page 1*c* moves upward in a different direction, and the same effect as in the above embodiment will result. In other words, the path of the light beam can be inclined at a predetermined angle to a line which crosses at right angles to the crest 1*d* of the bent page 1*c*.

In the embodiment described above, the sensor 78 is a photosensor. The sensor 78 can be replaced by another type of a non-contact sensor, such as an ultrasonic-wave sensor, which can also detect how the pages of the book 1 are turned. Further, instead of the light-emitting element 78*a*, an optical sensor or an ultrasonic-wave sensor, which serves as a signal generating and receiving element may be used. In this case, instead of the light-receiving element 78*b*, a member for reflecting the light beam or the ultrasonic wave.

As may be understood from the above, the printing apparatus according to the present invention can perform a high-quality printing of characters or images in a book, even if printing is repeated several times in the same region of any page, and can print data on the entire surface of any pages of a book, without damaging the book.

The present invention is not limited to the embodiment described above. Various changes and modifications can be made within the scope of the present invention.

Figure 15:
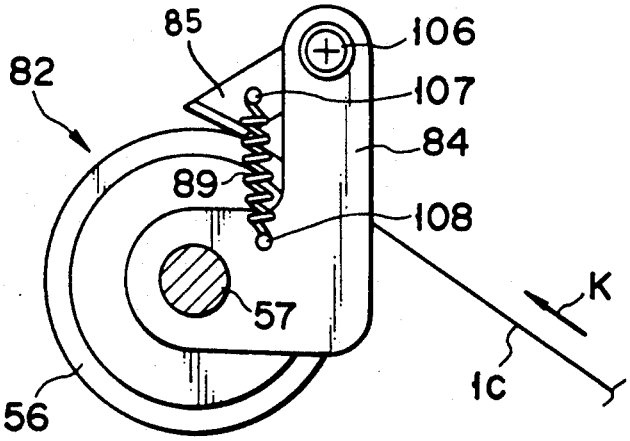
FIG. 15 is a side view schematically showing a modified chucking mechanism.

For instance, in the above embodiment, a tension is applied on a selected page of the book, other than the print page. However, a tension may be directly applied on the print page Either chucking member 82 of the chucking mechanism 80 can be replaced by the modified one shown in FIG. 15. The modified chucking member 82 comprises an L-shaped support plate 84. The support plate 84 is fastened to the platen shaft 57 and is rotated when the shaft 57 rotates. The support plate 84 has an end portion extending over the circumference of the platen roller 56. A chucking arm 85 is rotatably connected to the end portion of the support plate 84 by an axle 106. A tension spring 89 is stretched between pins 107 and 108 protruding from the arm 85 and the support plate 84, respectively. Due to the force of the spring 89, the arm 85 is pressed onto the circumference of the platen roller 56. The pin 107 is located forward of the line connecting the pin 108 and the axle 106, with respect to the direction K. The arm 85 is rotated by a drive unit (not shown) away from the platen roller 56, so that the fore-edge portion of the print page 1*c* may be inserted into the gap between the arm 85 and the circumference of the roller 56.

The force with which the arm 85 presses the fore-edge portion of the page 1*c* has a vector J which extends L opposite to the direction K in which the print page 1*c* is transported. Hence, when a tension is applied on the print page 1*c* in the direction opposite to the direction K, either chucking arm 85 is rotated to press the fore-edge portion of the page 1*c* firmly onto the circumference of the platen roller 56, reliably preventing the print page 1*c* from slipping out of the chucking arms 85 throughout the printing process. In other words, the modified chucking arms 85 (FIG. 15) can reliably hold the print page 1*c* at a predetermined position during the printing process, ensuring high-quality printing.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. An apparatus for printing data on any specified page of a book formed of a plurality of pages fastened together at a seam, said printing apparatus comprising:

means for positioning and holding a specified page of the book, on which to print data;

a tension-applying means for pulling any selected page of the book, other than the specified page, so as to apply a tension on the specified page through the seam of the book; and means for printing data on the specified page applied with the tension;

wherein said positioning/holding means comprises a support member for supporting the specified page and chucking means for cooperating with the support member to chuck the specified page, and said chucking means has a chucking member movable between a chucking position where the chucking member contacts said support member and a waiting position where the chucking member is remote from said support member, means for pressing said chucking member onto said support member with a force having a vector component extending in the same direction said tension acts on the specified page, when said chucking member moves to the chucking position, and means for detecting whether or not the specified page is clamped between said chucking member and said support member, in accordance with the position of said chucking member.

2. An apparatus according to claim 1, wherein said detecting means includes a detecting member attached to said chucking member to be rotated together with the chucking member, and a sensor for sensing the distance between the position which said detecting member takes when said chucking member is at the chucking position while the specified page is not clamped between the support member and the chucking member and the position and detecting member takes when said chucking member clamps the specified page at the chucking position.

3. An apparatus according to claim 1, wherein said detecting means has a pressure sensor provided on that portion of the chucking member which opposes said support member of said positioning/holding means.

4. An apparatus for printing data on any specified page of a book formed of a plurality of pages fastened together at a seam, said printing apparatus comprising:

book-transporting means for transporting the book to a predetermined position, while keeping a selected page of the book opened and located substantially parallel to the other pages including a specified page on which to print data;

a cylindrical rotatable support member arranged above the other pages of the book transported to said predetermined position and having an axis which extends substantially in parallel to the seam of the book;

page-turning means for turning the specified page from the other pages transported to said predetermined position and guiding the fore-edge portion of the specified page on a circumference of said support member;

means for holding the fore-edge portion of the turned specified page on said support member;

tension-applying means for pulling the selected page away from the specified page held by the holding means to apply a tension on the specified page through the seam of the book;

means for rotating the support member such that the specified page held by the holding means is wrapped around the circumference of the support member while applying the tension on the specified page by the tension-applying means; and means for printing data on the specified page wrapped around the support member;

said book-transporting means including:

guide means for supporting the book thereon and guiding the transportation of the book, the guide means having a guide section which is located below the other pages when the book is transported to said predetermined position and is movable between an upper position where the guide section supports the book and a lower position where the guide section is remote from the book; and guide driving means for holding the guide section at the upper position while said page-turning means turns the specified page, and for moving the guide section to the lower position during wrapping the specified page around the support member, so that the other pages hang downward.

5. An apparatus according to claim 4, wherein said book-transporting means further comprises:

said guide means including an upper guide and a lower guide which define a book-transporting path therebetween;

a plurality of lower rollers arranged along the book-transporting path;

a plurality of upper rollers arranged along the book-transporting path and contacting said lower rollers, the contacting portions of said lower rollers and upper rollers being located in the book-transporting path; and roller-driving means for driving either said lower rollers or said upper rollers, such that the book is transported through said book-transporting path, while being clamped between said lower rollers on the one hand, and said upper rollers on the other hand.

6. An apparatus according to claim 5, wherein said upper rollers and said lower rollers include upper clamping rollers and lower rollers which are arranged such that they clamp the selected page transported to said predetermined position; and said tension-applying means includes a roller support member supporting said upper clamping rollers such that said upper clamping rollers are movable into contact with said lower clamping rollers and away therefrom, means for biasing said upper clamping rollers toward said lower clamping rollers, and pressure-adjusting means for adjusting the pressure which said bias means applies to said upper clamping rollers, such that said upper clamping rollers contact said lower clamping rollers with a predetermined pressure when the book is transported or when the specified page is turned, and also such that said upper clamping rollers contact said lower clamping rollers with a pressure lower than the predetermined pressure and slip on said selected page to apply a tension onto the selected page while said printing means print data on the specified page.

7. An apparatus for printing data on any specified page of a book formed of a plurality of pages fastened together at a seam, said printing apparatus comprising:

book-transporting means for transporting the book to a predetermined position, while keeping a selected page of the book opened and located substantially parallel to the other pages including a specified page on which to print data, the book-transporting means including a pair of rollers for clamping the selected page, and means for rotating at least one of the rollers to transfer the book;

a cylindrical rotatable support member arranged above the other pages of the book transported to said predetermined position and having an axis which extends substantially in parallel to the seam of the book;

page-turning means for turning the specified page from the other pages transported to said predetermined position and guiding the fore-edge portion of the specified page on a circumference of said support member;

means for holding the fore-edge portion of the turned specified page on said support member;

means for rotating the support member such that the specified page held by the holding means is wrapped around the circumference of the support member;

means for printing data on the specified page wrapped around the support member; and tension-applying means for pulling the selected page away from the specified page held by the holding means to apply a tension on the specified page through the seam of the book, the tension-applying means including a rotatable contact member formed of one of said rollers of the book-transporting means, means for supporting the contact member to be movable to a first position wherein the contact member clamps, associated with the other roller, the selected page with a predetermined pressure, and a second position wherein the contact member clamps the selected page, associated with the other roller, with a pressure lower than the predetermined pressure, means for moving the contact member to the first position when the book is transported by the transporting means and when the specified page is turned by the page-turning means and for moving the contact member to the second position when the specified page is being wrapped around the support member and the printing means prints data on the specified page, and means for rotating at least one of the contact member and the other roller while the contact member is in the second position, so that the contact member slips on the selected page to pull the selected page;

said book-transporting means including:

guide means for supporting the book thereon and guiding the transportation of the book, the guide means having a guide section which is located below the other pages when the book is transported to said predetermined position and is movable between an upper position where the guide section supports the book and a lower position where the guide section is remote from the book; and guide driving means for holding the guide section at the upper position while said page-turning means turns the specified page, and for moving the guide section to the lower position during wrapping the specified page around the support member, so that the other pages hang downward.

* * * * *